United States Patent [19]

Enz et al.

[11] Patent Number: 4,912,086

[45] Date of Patent: Mar. 27, 1990

[54] ELECTROACOUSTIC TRANSDUCER COMPRISING A SUPERCONDUCTING ELEMENT

[75] Inventors: Ulrich E. Enz, Eindhoven, Netherlands; Albert A. Comberg, Aachen; Norbert E. F. Hansen, Roetgen, both of Fed. Rep. of Germany

[73] Assignee: U.S. Philips Corporation, New York, N.Y.

[21] Appl. No.: 123,448

[22] Filed: Nov. 19, 1987

[30] Foreign Application Priority Data

Jul. 16, 1987 [NL] Netherlands ..... 8701680

[51] Int. Cl.[4] ..... H04R 7/00; H04R 13/00; H04R 23/02

[52] U.S. Cl. ..... 505/1; 505/701; 505/705; 381/203; 381/204; 381/205; 381/188; 381/192; 181/167

[58] Field of Search ..... 381/202–205, 381/194–197, 192, 188; 181/157, 167; 367/173, 174, 190; 29/594, 599; 505/1, 701, 705

[56] References Cited

U.S. PATENT DOCUMENTS

| | | | |
|---|---|---|---|
| 3,497,642 | 2/1970 | Pintell | 381/202 |
| 4,228,327 | 10/1980 | Sawafuji | 381/196 X |
| 4,264,789 | 4/1981 | Kaizu et al. | 381/196 |
| 4,273,968 | 6/1981 | Suyama | 381/196 X |
| 4,413,161 | 11/1983 | Matsumoto et al. | 381/203 X |

OTHER PUBLICATIONS

"Keramische Supergeleiders"; *De Ingenieur*, No. 7/8; Jul./Aug. 1987; pp. 49–51.

*Primary Examiner*—Eugene R. Laroche
*Assistant Examiner*—Benny T. Lee
*Attorney, Agent, or Firm*—Bernard Franzblau

[57] ABSTRACT

An electroacoustic transducer comprises a terminal (1–1'), a voice coil (2) coupled to the terminal, and a diaphragm (4). The transducer further comprises an element (other than the voice coil) made of a superconducting material which cooperates with the voice coil (2) to provide electromechanical conversion of an electric signal appearing at the terminal (1–1') into vibrations of the diaphragm, or vice versa.

25 Claims, 1 Drawing Sheet

ELECTROACOUSTIC TRANSDUCER COMPRISING A SUPERCONDUCTING ELEMENT

BACKGROUND OF THE INVENTION

This invention relates to an electroacoustic transducer comprising a terminal for receiving or supplying an electric signal, a voice coil coupled to said terminal, and a diaphragm. Such a transducer is known from the book "Acoustics" by LL. Beranek, Chapters 6 and 7, McGraw-Hill Book Company.

The known transducer, in particular when constructed as a loudspeaker, has a large mounting height and is heavy and expensive. It is the object of an invention to provide a transducer which has a smaller mounting height, is lighter in weight and is less expensive.

SUMMARY OF THE INVENTION

To this end the electroacoustic transducer in accordance with the invention is characterized in that the transducer comprises an element, not being the voice coil, which is made of a superconducting material. This element is constructed to cooperate with the voice coil to provide electromechanical conversion of the electric signal on the terminal into vibrations of the diaphragm, or vice versa.

It is to be noted that the invention is not limited to the use of the superconducting element in electroacoustic transducers constructed as loudspeakers. The invention is equally applicable to electroacoustic transducers constructed as microphones. However, the following exposition will be based mainly on a transducer used as a loudspeaker.

The inventive step is based on the recognition of the following fact. Electromechanical conversion by means of the transducer in accordance with the invention is achieved in that a superconducting element inherently tends to repel magnetic fields. In the superconductivity theory this effect is referred to as the Meissner effect. The voice coil is intended to generate an alternating magnetic field depending on the electric signal applied to the terminal. Under the influence of this magnetic field the superconducting element and the voice coil will move relative to each other, causing the diaphragm to move, so that an acoustic signal is radiated. There are sundry advantages of a transducer in accordance with the invention. Since the voice coil is now the element which generates the magnetic field a permanent magnet may be dispensed with. The transducer therefore requires fewer components, is consequently lighter in weight, and is cheaper. Moreover, a smaller mounting height is obtained.

It will be evident that when the inventive step is applied to microphones the superconducting element must be situated in a permanent-magnet field. This permanent-magnet field can be obtained, for example, by applying a direct current to the voice coil. However, also in the case of loudspeakers comprising only one voice coil, applying a direct current to the voice coil will appear to be necessary for a satisfactory acoustic reproduction of an electric signal applied to the transducer.

The phenomenon of superconductivity has already been known for a long time, see for example the book "Introduction to solid state physics" by Kittel, Chapter 12.

It is also known to make conductors of a superconducting material in order to reduce the ohmic losses in these conductors. Furthermore, it is known to utilize superconducting materials for generating (strong) magnetic fields. Until now these applications were only possible at very low temperatures, namely temperatures below approximately −250° C. However, recently some materials have been demonstrated to exhibit superconductivity at (much) higher temperatures.

Suitable materials are, for example, superconducting (ceramic) materials constituted by compounds of lanthanum, $La_{1-x}{}^{BA}{}_{x}$-$CuO_4$, x ranging between 0.15 and 0.6; lanthanum, strontium, copper and oxygen, such as $La_{2-x}Sr_xCuO_4$, where x ranges between 0.15 and 0.2; yttrium, barium, copper and oxygen, such as $YBa_2Cu_3O_{7-d}$, where d ranges between 0.0 and 0.5, or $Y_{0.4}Ba_{0.6}Cu_{1.0}O_{3.0}$, or yttrium, barium, strontium, copper and oxygen, such as $YBa_{2-x}Sr_xCu_3O_8$, in which some of the elements may be substituted partly, for example fluorine for oxygen or calcium for strontium.

Although the use of the phenomenon of superconductivity in electroacoustic transduceres may have been proposed previously, it is to be noted that the inventive step neither relates to the replacement of a conductor by a conductor of a superconducting material nor to the realization of magnetic fields by means of an element of a superconducting material, but to the realization of an electromechanical conversion in transducers based on the Meissner effect.

The element made of a superconducting material may at least form a part of the diaphragm, while the voice coil is arranged in a stationary manner. This has the advantage that no electric leads to a moving part of the transducer, such as the voice coil of the known transducer, are required. This results in an increased reliability and life of the transducer. Moreover, it enables the mass of the moving part of the transducer to be reduced, so that the sensitivity of the transducer is higher and the operating-frequency range of the transducer can be extended.

The diaphragm may comprise a layer of a superconducting material. The voice coil can then be arranged on a substantially flat support and extend as a spiral over the support. If the diaphragm is a substantially flat diaphragm the support can be arranged on one side of and substantially parallel to the diaphragm. In this way a very flat construction having a small mounting height can be obtained.

A transducer in which the diagragm is a substantially conical diaphragm may be characterized in that at least the apex of the diaphragm is made of a superconducting material.

Another possibility is that the element is coupled to the apex of the diaphragm and that the voice coil is arranged to be stationary.

The transducer in its simplest form, i.e. comprising only one voice coil to which the electric signal is applied, is not capable of converting the electric signal into an acoustic signal without significant distortion. This results from the fact that the magnetic fields generated by the voice coil can only repel the element of supeconducting material, both during the positive and during the negative excursions of the electric signal. This means at least that the frequency of the acoustic signal is doubled. For some uses, for example sirens, this need not be a drawback. However, for consumer applications such a conversion is not acceptable.

An improvement can be obtained if the transducer comprises a second voice coil and if one voice coil, viewed along the central axis of the transducer, is situated before and the other voice coil, viewed in the same direction, is situated behind the element. If intended to convert an electric signal into an acoustic signal, this transducer may be characterized further in that the transducer comprises a separator unit having an input coupled to the connection terminal and having a first output and a second output coupled to the first voice coil and the second voice coil respectively, and in that the separator unit is constructed to transmit an electric signal of a first polarity to one voice coil and to transmit an electric signal of a polarity opposite to said first polarity to the other voice coil.

An improvement can also be obtained in a different way, namely in that the transducer comprises a drive unit having an input coupled to the terminal and an output coupled to the voice coil, and in that the drive unit is adapted to supply a constant current to the voice coil during operation of the transducer and in the absence of an electric or acoustic signal to be converted in the transducer. This embodiment is suitable for use of the transducer as a loudspeaker or as a microphone.

Another embodiment of the transducer in accordance with the invention is characterized in that the voice coil is coupled to the diaphragm and the superconducting element is arranged to be stationary. This embodiment is advantageous if a superconducting material in ceramic form is to be used in the transducer in accordance with the invention.

Moreover, the voice coil(s) can be made of a superconducting material. This has the advantage that (substantially) no heat is developed in the voice coil(s). This also improves the efficiency of the transducer because the ohmic losses in the voice coil(s) are now (substantially) zero.

BRIEF DESCRIPTION OF THE DRAWINGS

Some embodiments of the invention will now be described in more detail, by way of example, with reference to the accompanying drawing. In the drawing

DESCRIPTION OF THE PREFERRED EMBODIMENTS

Figure 1:
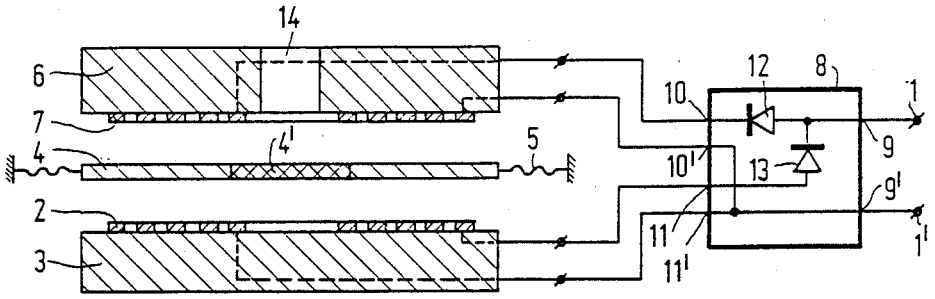
FIG. 1 shows a first.

FIG. 1 is a diagrammatical sectional view of a transducer in accordance with the invention. The transducer comprises a connection terminal 1-1 for receiving or supplying an electric signal, depending on whether the transducer is a loudspeaker or a microphone. The transducer of FIG. 1 will be described hereinafter as being a loudspeaker. The transducer further comprises a voice coil 2 which is stationary and which for this purpose is mounted on a support 3. The support 3 is flat and the voice coil 2 extends as a spiral over the surface of the support. The diaphragm 4 extends parallel to the support 3. At least a part of the diaphragm 4 is made of a superconducting material. This may mean that at least the central portion 4', i.e. the cross-hatched portion, of the diaphragm is superconducting. Another possibility is that the diaphragm comprises a layer of a superconducting material or is wholly made of a superconducting material. The diaphragm 4 is resiliently suspended by means of the compliant rim 5. The transducer further comprises a second support 6 carrying a second stationary voice coil 7 which also extends as a spiral over the surface of the support.

The support 6 is arranged on the side of the diaphragm 4 which is remote from the first support 3. The transducer further comprises a cross-over unit 8 having an input 9-9' coupled to the terminal 1-1' and two outputs 10-10' and 11-11' respectively. One output 10-10' is coupled to the voice coil 7 and the other output 11-11' is coupled to the other voice coil 2. The cross-over unit 8 is adapted to transmit an electric signal of a first polarity (positive) to the voice coil 7 and to transmit an electric signal of a polarity opposite to said first polarity to the other voice coil 2. For this purpose the cross-over unit comprises a first diode 12 arranged between the terminals 1 and 10 and a second diode 13 arranged between the terminals 1 and 11.

The support 6 is formed with an opening 14 for the passage of the acoustic signal produced by the vibration of the diaphragm 4 to the exterior of the transducer. If desired, the support 6 may be formed with further openings. Moreover, if desired, for example in order to realize a specific desired frequency response, the support 3 may be provided with one or more perforations.

The transducer operates as follows. During signals having positive amplitudes an electric signal is applied to, for example, the voice coil 7. The diode 13 is then cut off so that the voice coil 2 receives no signal. The voice coil 7 generates a magnetic field. As a result of the magnetic field the diaphragm will exhibit a downward excursion out of its rest position. During signals having negative amplitudes the voice coil 2 receives an electric signal. The diode 12 is now cut off so that no signal is applied to the voice coil 7. The voice coil 2 now generates a magnetic field under the influence of which the diaphragm 4 is given an upward excursion. The upward and downward excursions of the diaphragm are caused by the superconducting part of the diaphragm tending to repel the magnetic field. Thus, a repelling force is exerted on the diaphragm relative to the voice coil generating the magnetic field. As stated hereinbefore, this effect is refered to as the Meissner effect.

Figure 2:
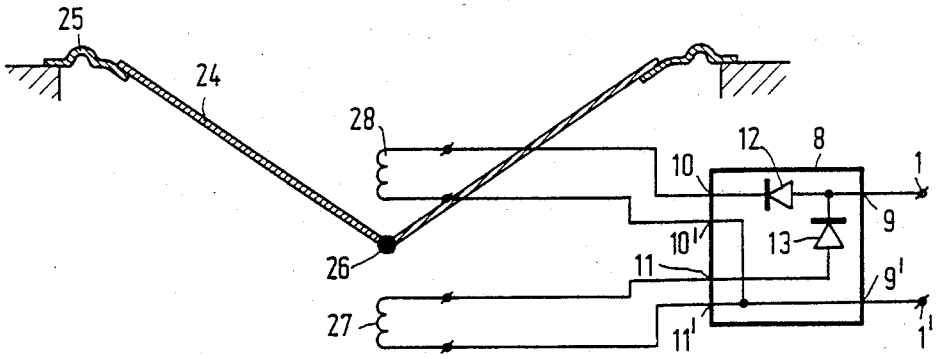
FIG. 2 shows a second.

FIG. 2 shows a second embodiment. In this case the diaphragm 24 is conical and is elastically suspended along its outer circumference by means of a compliant rim 25. At its apex the diaphragm 24 is provided with a superconducting element 26. Two voice coils 27 and 28 are stationarily arranged, respectively, ahead of and behind the element 26 viewed along a central axis through the transducer. The voice coils 27 and 28 are coupled to the outputs 11-11' and 10-10', respectively of the cross-over unit 8. The transducer of FIG. 2 operates in the same way as the transducer of FIG. 1.

In addition, in the embodiments of FIGS. 1 and 2 the voice coil(s) 2 (and 7) and 27 (and 28) may be made of a superconducting material. Instead of providing the diaphragm 24 with a superconducting element 26 which is affixed to the diaphragm at the location of the apex of the cone, it is also possible to make at least the apex itself of a superconducting material.

Figure 3:
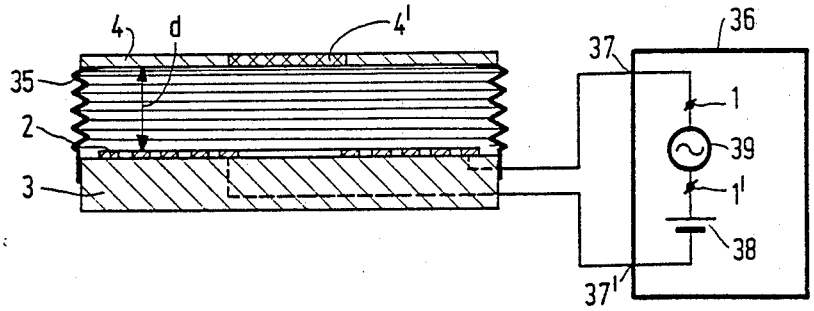
FIG. 3 shows a third embodiment of the transducer in accordance with the invention. Elements bearing the same reference numerals in the different Figures are identical.

FIG. 3 shows an embodiment comprising only one voice coil 2 which is arranged in a stationary manner. The diaphragm 4 with the superconducting part 4' is positioned at a specific distance from the support 3 carrying the voice coil 2 by means of a suspension 35. The transducer comprises a drive unit 36 having an output 37, 37' coupled to the voice coil 2. The drive unit 36 comprises a direct voltage source 38 in series with the electric signal source 39. The direct voltage source 38 produces a direct current through the voice coil 2 so that a constant (or permanent) magnetic field is produced which repels the diaphragm 4. The diaphragm occupies a position at such a distance d from the voice coil that the repelling force exerted on the diaphragm 4 by the magnetic field is equal to the attractive (mechanical) force exerted on the diaphragm 4 by the suspension 35 which is extended (under the influence of the excursion of the diaphragm up to a distance d from the voice coil). Here it is assumed that the diaphragm 4 is a stiff diaphragm. The signal source 39 causes the current through the voice coil 2 to vary about the d.c. bias. It is assumed that the maximum current variations are smaller than or equal to the value of the direct current supplied by the source 38.

The variations in current result in variations of the magnetic field, which in turn give rise to variations in the distance d between the diaphragm 4 and the voice coil 2. These variations result in the transducer producing an acoustic signal.

Conversely, the transducer of FIG. 3 can also be operated as a microphone. The signal source 39 must then be replaced by a current-sensing resistor. Acoustic signals incident on the diaphragm give rise to variations in the distance d as a function of time. This varying distance gives rise to variations in magnitude (strength) of the permanent magnetic field. These variations in their turn produce variations in the current through the voice coil and hence variations in the current through and consequently the voltage across the current-sensing resistor. The a.c. component of the voltage measured across the current-sensing resistor now constitutes the electric signal supplied by the microphone transducer at the terminals 1-1'.

It is to be noted that the scope of the invention is not limited to the embodiments shown. The invention also applies to embodiments which differ from the embodiments shown in ways which are not relevant to the invention.

For example, all of the embodiments shown and described comprise a supeconducting element coupled to or forming a part of the diaphragm, the voice coil being arranged to be stationary. However, it is alternatively possible to couple the voice coil in known manner to the diaphragm and to arrange the superconducting element to be stationary. In the embodiment shown in FIG. 3 this can be achieved by arranging the voice coil 2 on the diaphragm 4 and replacing the conductor on the support 3 by a superconducting layer.

Furthermore, it is obvious that the voice coil(s) can also be made of a superconducting material.

What is claimed is:

1. An electroacoustic transducer comprising a terminal for receiving or supplying an electric signal, a voice coil coupled to said terminal, and a diaphragm, characterized in that; the transducer includes an element other than the voice coil and said element is made of a superconducting material, and with said element constructed and positioned relative to the voice coil and diaphragm so as to cooperate with the voice coil and diaphragm to provide electromechanical conversion between the electric signal at the terminal and vibrations of the diaphragm.

2. An electroacoustic transducer as claimed in claim 1, wherein the superconducting element at least forms a part of the diaphragm and the voice coil is arranged to be stationary relative to a support member of the transducer.

3. An electroacoustic transducer as claimed in claim 2, wherein the superconducting element comprises a layer of superconducting material as a part of the diaphragm.

4. An electroacoustic transducer as claimed in claim 3, wherein the diaphragm is a substantially flat diaphragm, the voice coil is arranged on a substantially flat support and extends as a spiral over the support, and the support is arranged on one side of and substantially parallel to the flat diaphragm.

5. An electroacoustic transducer as claimed in claim 2 wherein the diaphragm comprises a substantially conical diaphragm, and at least the apex of the conical diaphragm is made of superconducting material.

6. An electroacoustic transducer as claimed in claim 1, wherein the diaphragm comprises a substantially conical diaphragm, the superconducting element is coupled to the apex of the conical diaphragm and the voice coil is arranged to be stationary.

7. An electroacoustic transducer as claimed in claim 4 wherein the transducer comprises a second voice coil and said voice coils are respectively situated on opposite sides of the superconducting element.

8. An electroacoustic transducer as claimed in claim 7, wherein the second voice coil is arranged on a second substantially flat support and extends as a spiral over the support, and the second support is arranged on that side of the flat diaphragm which is remote from the first support.

9. An electroacoustic transducer as claimed in claim 7, for converting the electric signal into an acoustic signal, wherein the transducer further comprises a separator unit having an input coupled to the terminal and having a first output and a second output coupled to the first voice coil and the second voice coil respectively, and wherein the separator unit is constructed to transmit an electric signal of a first polarity to one voice coil and to transmit an electric signal of a polarity opposite to said first polarity to the other voice coil.

10. An electroacoustic transducer as claimed in claim 1 wherein the transducer comprises a drive unit having an input coupled to the terminal and an output coupled to the voice coil, and wherein the drive unit is adapted to supply, during operation of the transducer, a constant current to the voice coil other than an electric or acoustic signal to be converted by the transducer.

11. An electroacoustic transducer as claimed in claim 1, wherein the voice coil is coupled to the diaphragm and the superconducting element is arranged stationary relative to a support member of the transducer.

12. An electroacoustic transducer as claimed in claim 1 wherein the voice coil is also made of a superconducting material.

13. An electroacoustic transducer as claimed in claim 2 wherein the diaphragm is a substantially flat diaphragm, the voice coil is arranged on a substantially flat support and extends as a spiral over the support, and the support is arranged on one side of and substantially parallel to the flat diaphragm.

14. An electroacoustic transducer as claimed in claim 3 wherein the diaphragm comprises a substantially conical diaphragm and at least the apex of the conical diaphragm is made of superconducting material.

15. An electroacoustic transducer as claimed in claim 1 wherein the transducer comprises a second voice coil and said voice coils are respectively situated on opposite sides of the superconducting element.

16. An electroacoustic transducer as claimed in claim 15, for converting the electric signal into an acoustic signal, wherein the transducer further comprises a separator unit having an input coupled to the terminal and having a first output and a second output coupled to the first voice coil and the second voice coil respectively, and wherein the separator unit includes means for supplying electric signals of one polarity to one voice coil and signals of opposite polarity to the other voice coil.

17. An electroacoustic transducer as claimed in claim 2 wherein the transducer comprises a drive unit having an input coupled to the terminal and an output coupled to the voice coil, and wherein the drive unit is adapted to supply a constant current to the voice coil other than an electric or acoustic signal to be converted by the transducer.

18. An electroacoustic transducer comprising: a terminal for an electric audio signals, a voice coil fixed in position relative to a support member of the transducer and electrically coupled to said terminal, a diaphragm mounted for vibratory movement relative to said support member, and an element, other than the voice coil, made of a superconducting material, and wherein said element is positioned and arranged relative to the voice coil and the diaphragm such that a current flow in the voice coil produces a magnetic field that interacts with the superconducting element by virtue of the Meissner effect, said superconducting element interacting with the voice coil and diaphragm so as to produce an electromechanical conversion between an audio signal at said terminal and audible vibrations of the diaphragm.

19. An electroacoustic transducer as claimed in claim 18 wherein said superconducting element comprises at least a part of the diaphragm.

20. An electroacoustic transducer as claimed in claim 19 wherein said diaphragm comprises a substantially planar diaphragm and the voice coil is affixed to a substantially planar support member positioned on one side of and substantially parallel to the planar diaphragm.

21. An electroacoustic transducer as claimed in claim 20 further comprising a second voice coil electrically coupled to said terminal and affixed to a second substantially planar support member positioned on the opposite side of the planar diaphragm and substantially parallel thereto whereby said first and second voice coils interact with the superconducting element by virtue of the Meissner effect.

22. An electroacoustic transducer as claimed in claim 18 further comprising a second voice coil electrically coupled to said terminal and fixed in a position so as to sandwich the superconducting element between the first and second voice coils such that a current flow in the second voice coil also produces a magnetic field that interacts with the superconducting element by virtue of the Meissner effect so as to operate approximately 180° out of phase with the first voice coil in producing an electromechanical conversion between an audio signal at said terminal and audible vibrations of the diaphragm.

23. An electroacoustic transducer as claimed in claim 6 wherein the voice coil also comprises a superconducting material.

24. An electroacoustic transducer as claimed in claim 10 wherein the voice coil also comprises a superconducting material.

25. An electroacoustic transducer as claimed in claim 7 wherein the voice coils are also made of a superconducting material.

* * * * *